US005551250A

United States Patent [19]

Yingst et al.

[11] Patent Number: 5,551,250

[45] Date of Patent: Sep. 3, 1996

[54] FREEZER EVAPORATOR DEFROST SYSTEM

[75] Inventors: Thomas E. Yingst; Gerald J. Stensrud, both of Bedford; Ronald S. Davis, Euless, all of Tex.

[73] Assignee: Traulsen & Co. Inc., College Point, N.Y.

[21] Appl. No.: 354,231

[22] Filed: Dec. 7, 1994

Related U.S. Application Data

[63] Continuation-in-part of Ser. No. 302,280, Sep. 8, 1994, Pat. No. 5,491,980.

[51] Int. Cl.[6] ..... F25D 21/12

[52] U.S. Cl. ..... 62/234; 62/278; 62/279

[58] Field of Search ..... 62/277, 278, 279, 62/234

[56] References Cited

U.S. PATENT DOCUMENTS

| | | | |
|---|---|---|---|
| 2,296,997 | 9/1942 | Knoy | 62/279 |
| 2,355,289 | 8/1944 | Gibson | 62/279 |
| 2,667,042 | 1/1954 | Anderson | 62/279 |
| 2,679,144 | 5/1954 | Grimshaw | 62/279 |
| 2,698,522 | 1/1955 | La Porte | 62/278 X |
| 2,797,560 | 7/1957 | Kooiker et al. | 62/279 X |
| 3,451,226 | 6/1969 | Shriver | 62/277 X |

*Primary Examiner*—William E. Tapolcai
*Attorney, Agent, or Firm*—S. C. Yuter, J.S.D.

[57] ABSTRACT

A freezer system is disclosed comprising a freezing mechanism and an adjacent freezer cabinet. The freezer mechanism has a compressor that produces hot gas refrigerant, a condenser, and an evaporator which accumulates ice on its outside surface. An evaporator condensate pan is mounted beneath the evaporator and a compressor condensate pan is mounted beneath the compressor and connected by a conduit to the evaporator condensate pan. A condensate pan heater coil is attached to the bottom of the evaporator condensate pan. A hot gas valve connected between the compressor and the condensate pan heater coil, when activated, conducts hot gas refrigerant to the condensate pan heater coil to heat it and thereby heat the attached evaporator condensate pan, which in turn heats the outside of the evaporator to help melt accumulated ice. The hot gas refrigerant is then fed from the condensate pan heater coil to the evaporator, heating the inside of the evaporator and fully melting the ice. The water drips into the evaporator condensate pan and flows to the compressor condensate pan. A condenser fan mounted adjacent the condenser moves outside air through the condenser and around the compressor to cool the condenser and compressor while heating the moved air, which is then passed over the water in the compressor condensate pan to evaporate it and expel it from the freezer system.

23 Claims, 3 Drawing Sheets

FREEZER EVAPORATOR DEFROST SYSTEM

This application is a continuation-in-part of the prior filed U.S. patent application Ser. No. 8/302,280 filed Sep. 8, 1994, for a Reversible Refrigerator/Freezer System (herein "Reversible Refrigerator/Freezer System Application"), now U.S. Pat. No. 5,491,980, whose disclosure is hereby incorporated into this application by reference. The inventors in both applications are the same and the applications are assigned to the same assignee.

BACKGROUND OF THE INVENTION

1. Field of the Invention

This invention relates to freezer systems for the storage of frozen foods, and more particularly to a system for defrosting the evaporator in such freezer systems.

2. Description of the Related Art

During normal freezer system operation, hot gas refrigerant from a compressor is fed to a condenser which condenses the refrigerant into a liquid. The liquid refrigerant is fed to an evaporator where it expands to cool the evaporator and thus an adjacent freezer cabinet for the storage of frozen foods. Ice builds up on the outside of the evaporator, especially during high humidity periods. The ice is removed by defrosting the evaporator.

One method for defrosting the evaporator of a freezer system is to feed hot gas refrigerant from the compressor to the inside of the evaporator to melt the moisture which freezes on the outside of the evaporator during normal freezer operation. During both normal and defrost freezer operation, the hot gas from the compressor first passes through a water evaporating plate and coil assembly located over the compressor to heat the plate surface and evaporate the moisture drained from the outside of the evaporator during the defrost cycle. Such a system is shown in Modern Refrigeration and Air Conditioning, published by The Goodheart-Willcox Company, Inc., South Holland, Ill., 1979, pages 313–316. Another method for defrosting the evaporator is electrically-heated elements mounted adjacent the evaporator.

A need developed, however, for a more efficient defrosting system, especially for undercounter freezer systems for restaurants.

SUMMARY OF THE INVENTION

The general object of the invention is to provide an improved system for defrosting the evaporator of a freezer system used for storing frozen foods.

Another object of the invention is to provide a more efficient freezer defrost system.

A further object of the invention is to provide an improved freezer defrost system which is especially useful for undercounter freezers for the storage of frozen foods in restaurants.

Briefly, in accordance with the invention, a freezer system is provided comprising a freezing mechanism and an adjacent freezer cabinet. The freezer mechanism has a compressor that compresses low pressure vapor refrigerant into high pressure hot gas refrigerant. A condenser condenses the high pressure hot gas refrigerant into high pressure liquid refrigerant which is expanded into low pressure liquid refrigerant and then fed to an evaporator to expand into vapor refrigerant to chill the outside of the evaporator. A blower draws air over the chilled evaporator and discharges freezing air into the adjacent freezer cabinet, during which the evaporator accumulates ice on its outside surface. The ice must be defrosted into condensate water to be removed. An evaporator condensate pan is mounted beneath the evaporator and a compressor section condensate pan is mounted beneath the compressor and connected by a condensate conduit to the evaporator condensate pan. A condensate pan heater coil is attached to the bottom of the evaporator condensate pan beneath the evaporator. A hot gas valve connected between the compressor and the condensate pan heater coil, when activated, conducts high pressure hot gas refrigerant from the compressor to the condensate pan heater coil to heat it and thereby heat the attached evaporator condensate pan, which in turn heats the outside of the evaporator above it to help melt ice accumulated on the outside of the evaporator. The high pressure hot gas refrigerant is then fed from the condensate pan heater coil to the evaporator, heating the inside of the evaporator and fully melting ice accumulated on the outside of the evaporator. The melted ice drips as condensate water into the evaporator condensate pan. The condensate water flows from the evaporator condensate pan via the condensate conduit to the compressor section condensate pan, where it is evaporated and expelled from the freezer system.

An advantage of the invention is that the condensate pan heating coil also melts any ice previously collected in the evaporator condensate pan. Thus ice cannot build up during repeated defrost cycles to inhibit circulation of air over the evaporator to chill the adjacent freezer cabinet.

Another advantage of the invention is that electrical heating of the evaporator is not required, with a consequent saving in energy and in the space occupied by the electrical elements and its controls.

A feature of the invention is a condenser fan mounted adjacent the condenser and adapted to move outside air through the condenser and around the compressor to cool the condenser and compressor while heating the moved air, which is then passed over the condensate water in the compressor section condensate pan to evaporate the condensate water and expel it from the freezer system.

And advantage of the combination of the hot gas defrost system and the compressor cooling and condensate evaporating system is that each uses heat from the compressor which would otherwise have to be expelled from the freezing system as wasted energy. That results in a more efficient freezing system.

Other objects, features and advantages of the invention and its features will be apparent from the following detailed description of the preferred embodiment of the invention taken together with the accompanying drawings.

Figure 3:
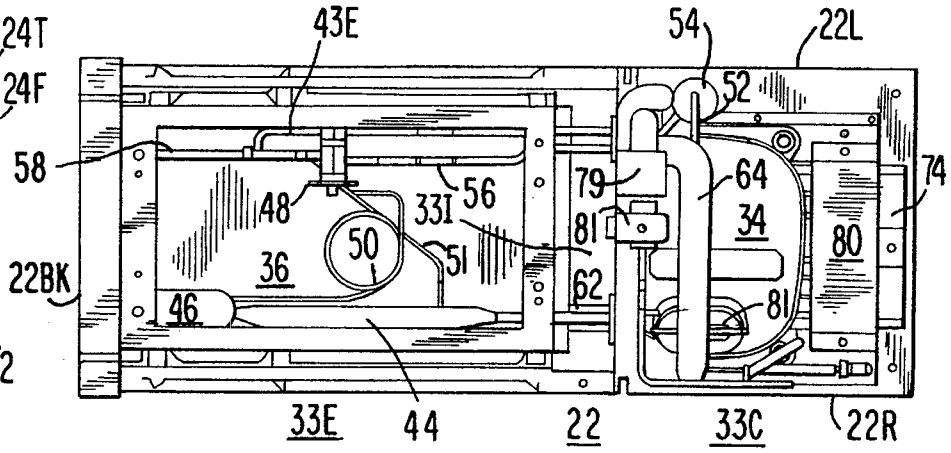
FIG. 3 (sheet 1) is a top view of the freezer mechanism of FIG. 2 taken just below the evaporator blower and looking through the evaporator (shown partially cross hatched), and top view of the compressor section side looking at the top of the compressor.

In the various figures of the drawings, like reference characters designate like parts. Also, like parts in this application and in the Reversible Refrigerator/Freezer System Application are designated by the same reference characters, but with specific refrigerator parts of the Reversible Refrigerator/Freezer System Application replaced by specific freezer parts.

DESCRIPTION OF THE PREFERRED EMBODIMENT

Figure 1:
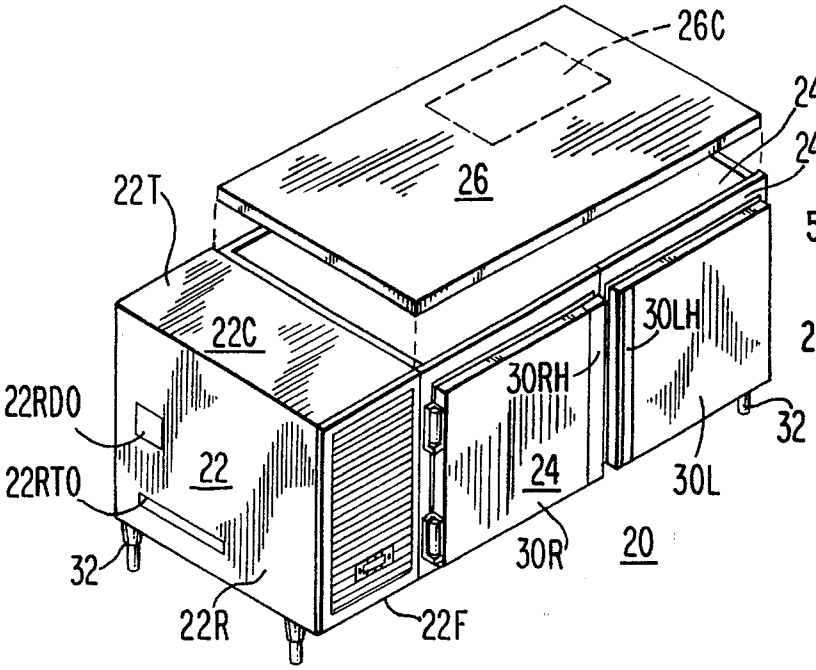
FIG. 1 is an isometric view of a freezer system showing a separately encased freezer mechanism removably attached to one side of the freezer cabinet, and a removable counter top in an exploded view.

Referring to FIG. 1 of the drawings, there is shown a reversible freezer system 20 comprising a separately encased freezing mechanism 22 which is removably attached to the right side of a separately encased freezer cabinet 24 which has a removable counter top 26. The top surface of the removable counter top 26 is in the same plane as the top surface of the freezing mechanism 22. The freezer system 20 is especially useful as a work counter in the kitchen, preparation area or serving area of a restaurant.

The freezer mechanism 22 can also be attached to the left side of the freezer cabinet 24 in accordance with the invention disclosed and claimed in the Reversible Refrigerator/Freezer System Application.

Freezing mechanism 22 (FIGS. 1–4) has a front panel 22F, a right panel 22R, a top panel 22T, a left panel 22L, a back panel 22BK and a bottom panel 22BT which, together with panels 22F, 22R and 22T, completely encase the freezing mechanism 22.

Right panel 22R (FIG. 1) has a discharge opening 22RDO and a return opening 22RTO. Corresponding discharge and return openings (not shown) on the left side of the freezing mechanism 22 serve to discharge freezing air into and return warmer air from the freezer cabinet 24. A stainless steel panel, called a vanity skirt because it fully covers right panel 22R and thus the discharge opening 22RDO and return opening 22RTO, is not shown.

Freezer cabinet 24 (FIG. 1) has a front panel 24F and top panel 24T which together with a right panel, left panel, back panel and bottom panel (not shown) completely encase the freezer cabinet 24. Doors 30R and 30L are mounted in corresponding openings in front panel 24F of freezer cabinet 24 to access the inside of the freezer cabinet 24. Door 30R has a recessed handle 30RH along its opening side and Door 30L has a recessed handle 30LH along its opening side. The recessed handles 30RH and 30RL are disclosed and claimed, together with the thermal breakers of doors 30R and 30L in the prior filed copending U.S. patent application Ser. No. 08/302,630 filed Sep. 8, 1994, for a Refrigerator/Freezer Thermal Breaker and Door Handle, whose disclosure is hereby incorporated into this application by reference. The inventors in both applications are the same and the applications are assigned to the same assignee.

The top panel 22T (FIG. 1) of the freezing mechanism 22 has a height which exceeds the height of the top panel 24T of the freezer cabinet 24 by the thickness of the removable counter top 26 so that the top surface of the removable counter top 26, when attached, is in the same plane as the top surface of the freezing mechanism 22 to provide a common work surface, as disclosed and claimed in the Reversible Refrigerator/Freezer System Application.

The removable counter top 26 is connected by screws (not shown) to top panel 24T of freezer cabinet 24. Shown in dotted outline as 26C is an opening for a condiment tray.

Legs 32 (FIG. 1) on the outside corners of freezer mechanism 22 and freezer cabinet 24 (three are shown) support the freezer system 20. Legs 32, which are attached at the restaurant site, are preferably mounted on rollers.

As explained in greater detail in the Reversible Refrigerator/Freezer System Application, freezing mechanism 22 can be attached to either the right side of freezer cabinet 24, as shown, or to the left side of freezer cabinet 24.

The freezing mechanism 22 can be attached to one side of the freezer cabinet 24 at the factory, or shipped separately to a restaurant for attachment at the site, or switched from one side to the other at the site.

The freezing mechanism 22 can also be supplied separately for use by freezer system cabinet makers.

Figure 2:
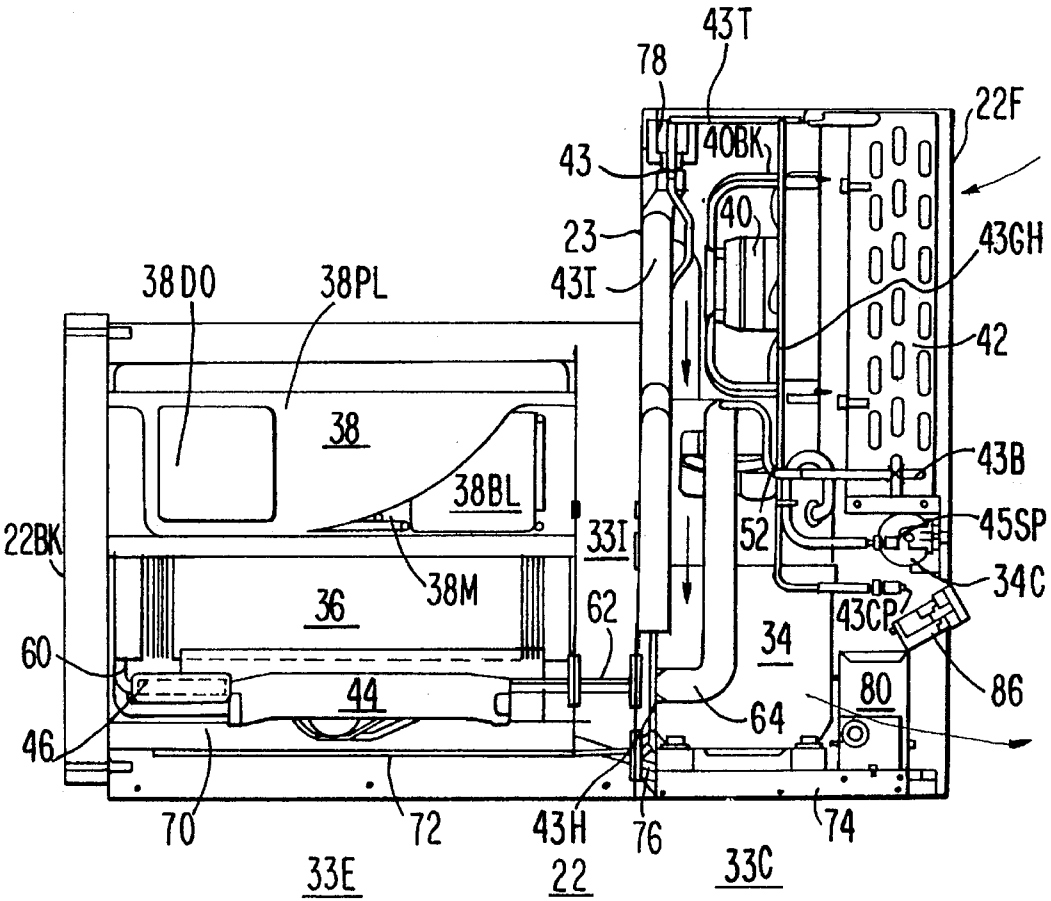
FIG. 2 (sheet 2) is a side elevational view of the freezer mechanism of FIG. 1, in accordance with the preferred embodiment of the invention, with the side panel of its case removed showing the evaporator section on the left side with the evaporator condensate pan at the bottom and with the condensate pan heater coil attached to its bottom. The arrows in the compressor section on the right side show the direction of the forced air of the combined compressor and condenser cooling and condensate removal system which expels condensate moisture from the compressor section condensate pan at the bottom.

Referring to FIGS. 2 and 3, the freezing mechanism 22 comprises an evaporator section 33E at the left and a compressor section 33C at the right separated by thermal insulation wall 33I.

Evaporator section 33E (FIG. 2) has an evaporator 36, an evaporator blower 38, an accumulator 44 and an insulated sensing bulb 46 which is connected to a thermal expansion valve (TXV) 48 (FIG. 3) via a coiled capillary tube 50. The cross hatching on the evaporator 36 (FIG. 2) represents fins.

The evaporator blower 38 draws warmed air from the freezer cabinet 24 (FIG. 1) evenly across the evaporator 36 (FIG. 2) to chill the air to below freezing temperature and discharges the freezing air back into the freezer cabinet 24. The freezing air discharged into the freezer cabinet 24 has a temperature in the range of −5° F. to 0° F.

The evaporator blower 38 (FIG. 2) comprises on a common shaft two centrifugal blowers 38BL with an intermediate electric motor 38M for rotating the centrifugal blowers 38BL at high speed. Each of the centrifugal blowers 38BL (FIG. 5) is respectively mounted in a scroll (not shown). Surrounding the centrifugal blowers 38BL and motor 38M is an inverted U-shaped plenum 38PL. The wide end of each scroll is connected to a similarly shaped opening on the inside top of plenum 38PL. On the outside of each side of the plenum 38PL is a discharge outlet 38DO.

In operation, motor 38M turns the centrifugal blowers 38BL at high speed. The vanes of each centrifugal blower 38BL draw warmed air over the evaporator 36 to freeze the air, which is then drawn through the rotating centrifugal blowers 38BL into the associated scroll, compressing the air in the narrow portion of the scroll and then expanding the air in the broader portion of the scroll. A forced freezing air stream is thus discharged from one of the two rectangular discharge outlets 38DO on each side of the plenum 38PL, the other of which is covered. Each of the discharge outlets 38DO (FIG. 1) is in registry with a matching opening in the respective side panels 22R and 22L of the freezer mechanism 22, as explained in detail in the Reversible Refrigerator/Freezer System Application.

Compressor section 33C (FIG. 2) has a compressor 34, a condenser fan 40 and a condenser coil 42. The condenser fan 40 and condenser coil 42 are mounted adjacent the compressor 34.

Hot compressed refrigerant gas under high pressure from the compressor 34 is fed via hot gas tube 43 to the top of the condenser coil 42 via tube 43T and exits from the bottom of condenser coil 42 via tube 43B as a high pressure liquid refrigerant. The high pressure liquid refrigerant is fed via tube 52 (FIGS. 2 and 3) to the filter drier 54 (FIG. 3), and then via tube 56, which passes through thermal insulation wall 33I, to the thermal expansion valve (TXV) 48. Tube 58 connects the outlet of thermal expansion valve 48 to the inlet of evaporator 36. The outside of tube 52 is soldered to the outside of suction line 64 to provide a heat exchange.

The outlet of the evaporator 36 (FIG. 2) is connected by tube 60 to the inlet of the insulated sensing bulb 46 whose outlet is connected to the inlet of accumulator 44 whose outlet is connected by tube 62, which passes through thermal insulation wall 33I, to an insulated suction line 64 (FIG. 3) connected to the inlet of compressor 34.

Figure 4:
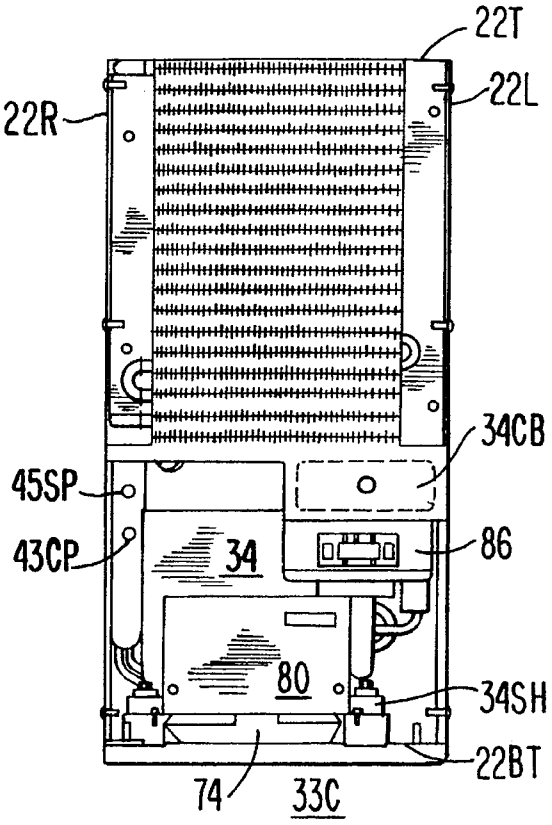
FIG. 4 (sheet 2) is a side elevational view of the front of the freezer mechanism of FIG. 2 with the front panel removed, and especially showing the condenser coil, compressor and the compressor section condensate pan beneath the compressor.

An aluminum evaporator condensate pan 70 (FIG. 2) is mounted beneath the evaporator 36 to collect defrosted condensate water which drips from the melting ice on the outside of the evaporator 36 during the defrost cycle. A compressor section condensate pan 74 is mounted below the compressor 34. A condensate tube 76 conducts the condensate water in the evaporator condensate pan 70 through the thermal insulation wall 33I to the compressor section condensate pan 74 beneath compressor 34 (FIGS. 2 and 4).

Figure 5:
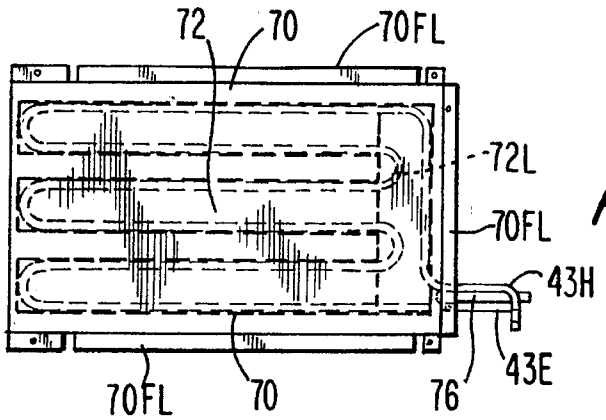
FIG. 5 (sheet 1) is a top view of the evaporator condensate pan of FIG. 2 showing in dotted outline the condensate pan heater coil attached to the bottom of the evaporator condensate pan.

A hot gas condensate heater 72 (FIGS. 2 and 5) comprises three loops 72L of copper tubing which are attached in contact with the bottom side of evaporator condensate pan 70 by aluminum tape 73 (FIG. 5). The copper tubing loops 72L are shown in light dotted outline beneath the evaporator condensate pan 70 and the aluminum tape 73 in darker dotted outline beneath the evaporator condensate pan 70.

The condensate tube 76 (FIG. 2) is welded into a hole in the front side of the evaporator condensate pan 70 with the bottom inside edge of the condensate tube 76 substantially in line with the inside bottom surface of the evaporator condensate pan 70. The evaporator condensate pan 70 slopes about ten degrees towards the condensate tube 76 connection so that there is no buildup of condensate water in the evaporator condensate pan 70. That maximizes the heat radiated from the hot bottom of the evaporator condensate pan 70 which helps melt ice on the outside of evaporator 36.

Flanges 70FL of the evaporator condensate pan 70 are welded to an inside wrapper (not fully shown) of the evaporator section 33E to mount the evaporator condensate pan 70 below the evaporator 36. The wrapper has a left side, a right side, a top side and a front side, with the evaporator condensate pan 70 comprising the bottom side. The rear side is left open to access the evaporator section 33E from the back side via removable back panel 22BK (FIG. 2). The purpose of the wrapper is to contain the stream of air coming from the freezer cabinet 24, which passes over the evaporator 36 and is discharged as freezing air back into the freezer cabinet 24. The sides of the wrapper also provide an enclosure for insulation blown into the space between the wrapper and the outside of the evaporator section 33E, including the insulation 33I.

A solenoid-operated hot gas valve 78 (FIG. 2) is connected between the hot gas tube 43 output of the compressor 34 and the inlet of hot gas condensate heater 72 via bypass tube 43H (FIGS. 2 and 5) which passes through the insulation 43I. The hot gas tube 43 is also connected by tube 43T to the inlet of condenser 42. The outlet of hot gas condensate heater 72 is connected via bypass tube 43E (FIGS. 3 and 5), which passes through compressor section 33C, to the inlet of evaporator 36. A tube 43CH also connects the hot gas tube 43 to a hot gas discharge port 43HP, adjacent to a suction charging port 45SP. All of the tubes 43 carry hot gas refrigerant. The temperature of the hot gas refrigerant at the inlet of hot gas condensate heater 72 is in the range of 150° F. to 200° F. depending on ambient room temperature.

The hot gas valve 78 is controlled by wires in the valve junction box 79 (FIG. 3). A bracket 81 holds the hot gas valve 78.

The compressor section 33C (FIG. 4) also includes a master junction box 80 which houses most of the electrical connections of the freezing system 22 and an electronic control unit 86 for controlling the freezing mechanism 22. Brackets 40BK support the motor 40M of the condenser fan 40. The compressor 34 is mounted on four shock absorbers 34SH connected via brackets to the bottom panel 22BT. A smaller junction box 81 (FIG. 3) contains the wires for control of the compressor 34.

The electronic control unit 86, in which the temperature parameters of the freezing mechanism 22 are set, controls the compressor 34 and condenser fan 40 motors and turns on the evaporator blower motor 38M, which remains on during the operation of the freezing mechanism 22.

The electronic control unit 86 also includes a defrost timer which controls the activation of the hot gas valve 78 and thus the defrost timer cycle, which is every six hours, with each defrost cycle lasting two minutes, followed by a drip time of an additional two minutes to allow defrosted condensate water to drip into the evaporator condensate pan 70. Then the freezer cycle resumes.

The compressor section 33C (FIG. 4) is fully enclosed by the right panel 22R, the left panel 22L, the front panel 22F, the bottom panel 22BT, the top panel 22T and a rear panel 23 (FIG. 2) adjacent the insulating wall 33I. Tubes 62 and 76 pass through insulating wall 33I and grommets in rear panel 23. The front panel 22F (FIG. 1) has vertical louvers which permit the passage of air in and out of the freezing mechanism 22.

The heat from the compressor 34 (FIG. 2) and the heat generated in the condenser coil 42 is exhausted from the encased freezing mechanism 22 into the surrounding air together with condensate in compressor section condensate pan 74 by a forced air stream produced by the condenser fan 40.

The direction of the forced air stream in the fully enclosed compressor section 33C is shown by four arrows in FIG. 2. Ambient air from outside the freezing mechanism 22 is drawn through the upper louvers of front panel 24, then through the condenser coil 42, to cool the condenser coil 42 while heating the forced air, then around the compressor 36, to cool the compressor 36 while further heating the forced air to a temperature in the range of 140° F.–160° F., then over the evaporator condensate in the compressor section condensate pan 74, and is then expelled out of lower louvers of front panel 24 back into the ambient air. The power and speed of the condenser fan 40 produces a forced air stream in the range of 350 to 450 cubic feet per minute. In that way condensate water in the compressor section condensate pan 74 is removed and expelled with the forced air from the compressor section 33C without the need for electrical heaters within the second evaporator condensate pan 74.

The refrigerant is refrigerant 134*a*.

Figure 6:
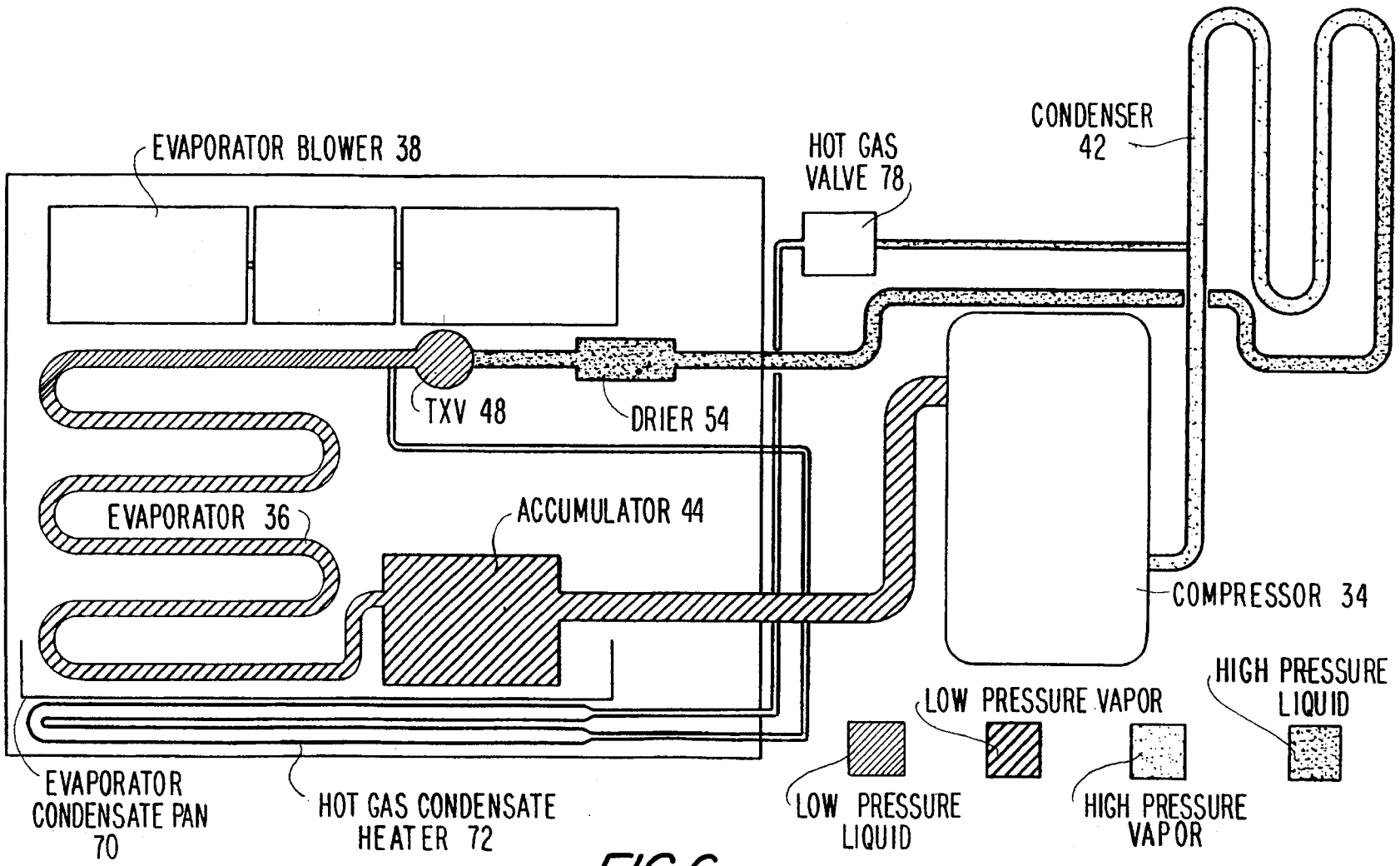
FIG. 6 (sheet 3) is a schematic diagram of the freezer mechanism including the hot gas defrost system, with the state of the refrigerant at each stage shown in coded cross-section.

FIG. 6 (sheet 2) is a schematic diagram of the freezer mechanism including the hot gas defrost system, with the state of the refrigerant at each stage shown in coded cross-section.

The high pressure liquid refrigerant exiting from the condenser 42 passes through the drier 54 to the expansion valve (TXV) 48, which lowers the pressure of the liquid refrigerant, which then expands into a low pressure vapor in the evaporator 36, thus extracting heat from the evaporator coil 42 making it freezing cold. The refrigerant as a low pressure gas then passes through the accumulator 44 and is then compressed into a very dense hot gas by the compressor 34 and then condensed into a liquid in the condenser coil 42, where it expels the heat absorbed into the refrigerant by the evaporator 36. The liquid refrigerant then at high pressure is returned to the drier 54 and thermal expansion valve 46.

During the defrost cycle, the very dense hot gas from the compressor 34 passes through the activated hot gas valve 78 to the inlet of the hot gas condensate heater 42 and from its outlet to the evaporator side of the expansion valve (TXV) 48 directly into the inlet of the evaporator 36. The hot gas in the hot gas condensate heater 72 rapidly heats the attached evaporator condensate pan 70. The heated evaporator condensate pan 70 then melts any ice in it, and then the heat from the evaporator condensate pan 70 and hot condensate water rises to heat the outside of the evaporator 36, to help melt the ice on the evaporator 36. The hot gas fed to the inside of the evaporator 36 then fully melts the remaining ice, which drips as condensate water into the evaporator condensate pan 70.

As explained above, condensate in the evaporator condensate pan 70 (FIG. 2) passes through conduit tube 76 to the compressor section condensate pan 74, where it is evaporated by the hot forced air drawn through the condenser 42 by the condenser motor 40 and over the compressor 34 to be expelled from the compressor section 33C into the ambient air. In that way, ice on the evaporator 36 is defrosted and expelled as evaporated moisture from the freezer mechanism 22 by the inventive combination of the hot gas defrost system and the compressor cooling and condensate evaporation system.

More particularly, a low pressure refrigerant gas and liquid mixture exits the evaporator 36 (FIG. 2) and, via the insulated sensing bulb 46, accumulates in the accumulator 44. The low pressure refrigerant mixture is then returned to the compressor 34 to be compressed and then condensed by the condenser 42 into a high pressure liquid refrigerant. The liquid refrigerant is then filtered and dried by the filter drier 54 (FIG. 3) and then fed to the thermal expansion valve 48.

The insulated sensing bulb 46 controls the thermal expansion valve 48 via the capillary tube 50. The expansion valve 48 is also controlled by an adjacent external equalizer tube 51 which is connected to the accumulator 44 and senses the low pressure side of the evaporator. The insulated sensing bulb 46, in response to the temperature of the evaporator 36, meters or modulates a diaphragm in the thermal expansion valve 48 to open it, control the size of the opening and close it, depending on the temperature, thus controlling the amount of expansion of the refrigerant in the evaporator 36. The external equalizer tube 51 provides for a smoother response by the thermal expansion valve 48.

The accumulator 44 (FIG. 2) provides a storage place for the refrigerant. Normally, the freezing mechanism 22 tries to maintain the temperature inside the freezer cabinet 24 at about −5° F. to 0° F. But if the temperature in the cabinet 24 suddenly rises, the air drawn from the cabinet 24 into the freezing mechanism 22 and through the evaporator 36 suddenly heats up. That increases the temperature of the evaporator 36 causing low pressure liquid refrigerant in the evaporator 36 to gasify and the accumulator 44 takes up the slack, and that protects the compressor 34.

The thermal expansion valve 46 (FIG. 2) is designed so that no liquid refrigerant will flow through it unless the pressure in the evaporator 36 is reduced by the running of the compressor 34. A compressor motor control thermocouple, not shown, is connected to the bottom of the evaporator 36 directly in the air stream and senses air temperature. When the temperature of the evaporator 36 has been reduced to the desired temperature, the compressor motor control turns off the compressor 34. When the compressor 34 is off, the compressor fan 40 is also off. The compressor capacitor 34C starts the compressor 34. Capacitor bracket 34CB (FIG. 4) mounts the compressor capacitor 34C.

Freezer cabinet 24 is fully insulated by blown-in thermal insulation 24I except for the door openings 30OP. The cabinet doors 30R and 30L (FIG. 1) are similarly thermally insulated. Similarly, the evaporator section 33E (FIG. 2) of the freezing mechanism 22 is fully insulated along its internal periphery in addition to thermal insulation wall 33I. Rear panel 22BK is a removable insulated wall panel and may be removed for servicing the evaporator section 33E. The front panel 22F (FIG. 1) is also removable for servicing the compressor section 33C (FIG. 2).

Thus all of the objects and advantages of the invention and its features, as stated at the beginning of this specification, are accomplished.

It is understood that the construction shown and described herein is merely illustrative of the invention and its features and that the invention and its features may be embodied in other forms within the scope of the claims.

What is claimed is:

1. A freezer evaporator defrost system comprising:

(A) a compressor for compressing low pressure vapor refrigerant into high pressure hot gas refrigerant;

(B) a condenser for condensing high pressure hot gas refrigerant from said compressor into high pressure liquid refrigerant;

(C) thermal expansion means for expanding high pressure liquid refrigerant from said compressor into low pressure liquid refrigerant;

(D) an evaporator having an inlet for receiving and evaporating the low pressure liquid refrigerant from said thermal expansion means to cool said evaporator whereby the outside surface of said evaporator accumulates ice;

(E) an evaporator condensate container mounted beneath said evaporator;

(F) an evaporator condensate container heater coil attached to and in thermal contact with the bottom of said evaporator condensate container, said evaporator condensate container heater coil having an inlet and an outlet;

(G) a hot gas tube connecting the outlet of said evaporator condensate container heating coil directly to the low pressure side of said thermal expansion means and thereby directly to the inlet of said evaporator;

(H) a hot gas valve for conducting when activated high pressure hot gas refrigerant from said compressor to the inlet of said evaporator condensate container heater coil to heat said evaporator condensate container heater coil and thereby heat said attached evaporator condensate container;

(I) heated air from said heated evaporator condensate container rising to heat the outside of said evaporator to help melt ice accumulated on the outside of said evaporator into condensate water which drips into said evaporator condensate container;

(J) the high pressure hot gas refrigerant fed from the outlet of said evaporator condensate container heater coil via said hot gas tube directly to the inlet of said evaporator heating the inside of said evaporator and melting ice accumulated on the outside of said evaporator into condensate water which drips into said evaporator condensate container;

(K) condensate evaporating means separate from said evaporator condensate container for evaporating the condensate water in said evaporator condensate container; and (L) a compressor condensate container mounted beneath said compressor and connected by a condensate conduit to said evaporator condensate container to conduct condensate water from said evaporator condensate container to said compressor condensate container;

(M) said condensate evaporating means comprising a condenser fan mounted horizontally adjacent said condenser and vertically over said compressor and adapted to move outside air through said condenser and around said compressor to cool said condenser and compressor while heating the moved air, which is then passed over the condensate water in said compressor condensate container to evaporate the condensate water solely by said heated moved air and expel it from the freezer system.

2. The freezer evaporator defrost system of claim 1 wherein the bottom of said compressor condensate container is below the bottom of said evaporator condensate container.

3. The freezer evaporator defrost system of claim 2 wherein said condensate conduit is connected to an opening in the side of said evaporator condensate container with the bottom inside edge of said condensate conduit substantially in line with the inside bottom surface of said evaporator condensate container, and with said inside bottom surface sloping towards said opening to avoid buildup of condensate water in said evaporator condensate container.

4. The freezer evaporator defrost system of claim 1 wherein the temperature of the hot air passed over the condensate water in said compressor condensate container is in the range of 140° F.–160° F.

5. The freezer evaporator defrost system of claim 1 wherein the temperature of the hot air gas refrigerant at the inlet of said hot gas condensate heater is in the range of 150° F. to 200° F. depending on ambient room temperature.

6. The freezer evaporator defrost system of claim 1 further comprising electronic control means for activating a defrost cycle after a predetermined freezing cycle time and maintaining said defrost cycle for a predetermined defrost period of time.

7. The freezer evaporator defrost system of claim 6 wherein said electronic control means also delays the start of the freezing cycle for a predetermined evaporator dripping period of time after said defrost cycle.

8. The freezer evaporator defrost system of claim 6 wherein said predetermined freezing cycle time is substantially six hours and said predetermined defrost period of time is substantially two minutes.

9. The freezer evaporator defrost system of claim 7 wherein said predetermined evaporator dripping period of time is substantially two minutes.

10. The freezer evaporator defrost system of claim 1 wherein said condensate container heater coil is made from copper and said evaporator condensate container is made from aluminum, and said condensate container heater coil is attached to and in thermal contact with the bottom of said evaporator condensate container by aluminum tape.

11. The freezer evaporator defrost system of claim 1 wherein said condensate evaporating means further comprises:

(A) a compressor section separate from said evaporator including said compressor;

(B) enclosure means for enclosing said compressor section on all sides except for one side;

(C) a panel on said one side of said compressor section having a top opening adjacent its top and a bottom opening adjacent its bottom;

(D) said condenser fan moving air drawn through said top opening of said panel, through said condenser to warm the moved air, around said compressor to further warm the moved air, then over the condensate water in said compressor condensate container to evaporate the condensate water solely by said warmed moved air, and then expel the evaporated condensate water in the moved air out said bottom opening of said panel.

12. The freezer evaporator defrost system of claim 11 wherein the bottom of said compressor condensate container is below the bottom of said evaporator condensate container, and said condensate conduit is connected to an opening in the side of said evaporator condensate container with the bottom inside edge of said condensate conduit substantially in line with the inside bottom surface of said evaporator condensate container, and with said inside bottom surface sloping towards said opening to avoid buildup of condensate water in said evaporator condensate container.

13. The freezer evaporator defrost system of claim 1 whereby the heating of said evaporator condensate container also melts any ice previously accumulated in said evaporator condensate container.

14. A freezer evaporator defrost system comprising a freezer mechanism and an adjacent freezer cabinet for the storage of frozen foods, said freezer mechanism comprising:

(A) a compressor for compressing low pressure vapor refrigerant into high pressure hot gas refrigerant;

(B) a condenser for condensing high pressure hot gas refrigerant from said compressor into high pressure liquid refrigerant;

(C) thermal expansion means for expanding high pressure liquid refrigerant from said compressor into low pressure liquid refrigerant;

(D) an evaporator having an inlet for receiving and evaporating the low pressure liquid refrigerant from said thermal expansion means to cool said evaporator whereby the outside surface of said evaporator accumulates ice;

(E) blower means adjacent said evaporator for blowing freezing air drawn over said evaporator into said adjacent freezer cabinet;

(F) an evaporator condensate container mounted beneath said evaporator;

(G) a compressor condensate container mounted beneath said compressor and connected by a condensate conduit to said evaporator condensate container;

(H) an evaporator condensate container heater coil attached to and in thermal contact with the bottom of said evaporator condensate container, said evaporator condensate container heater coil having an inlet and an outlet;

(I) a hot gas tube connecting the outlet of said evaporator condensate container heater coil directly to the low pressure side of said thermal expansion means and thereby directly to the inlet of said evaporator;

(J) a hot gas valve for conducting when activated high pressure hot gas refrigerant from said compressor directly to the inlet of said evaporator condensate container heater coil to heat said condensate container heater coil and thereby heat said attached evaporator condensate container;

(K) the heat from said heated evaporator condensate container then heating the outside of said evaporator to help melt ice accumulated on the outside of said evaporator into condensate water which drips into said evaporator condensate container;

(L) high pressure hot gas refrigerant fed via said hot gas tube from the outlet of said evaporator condensate container heater coil directly to the inlet of said evaporator heating the inside of said evaporator and further melting ice accumulated on the outside of said evaporator into condensate water which drips into said evaporator condensate container;

(M) said condensate water flowing from said evaporator condensate container via said condensate conduit to said compressor condensate container;

(N) and condensate evaporating means separate from said evaporator condensate container for evaporating the condensate water in said compressor condensate container;

(O) said condensate evaporating means comprising a condenser fan mounted horizontally adjacent said condenser and vertically over said compressor and adapted to move outside air through said condenser and around said compressor to cool said condenser and compressor while heating the moved air, which is then passed over the condensate water in said compressor condensate container to evaporate the condensate water solely by said heated moved air and expel it from the freezer system.

15. The freezer evaporator defrost system of claim 14 wherein the temperature of the hot air passed over the condensate water in said compressor condensate container is in the range of 140° F.–160° F. and the movement of the hot air is in the range of 350 to 450 cubic feet per minute.

16. The freezer evaporator defrost system of claim 14 wherein the temperature of the hot gas refrigerant at the inlet of said hot gas condensate heater is in the range of 150° F. to 200° F. depending on ambient room temperature.

17. The freezer evaporator defrost system of claim 14 further comprising electronic control means for activating a defrost cycle after a predetermined freezing cycle time and maintaining said defrost cycle for a predetermined defrost period of time.

18. The freezer evaporator defrost system of claim 17 wherein said electronic control means also delays the start of the freezing cycle for a predetermined evaporator dripping period of time.

19. The freezer evaporator defrost system of claim 14 whereby the heating of said evaporator condensate container also melts any ice previously accumulated in said evaporator condensate container.

20. A freezer evaporator defrost system comprising a freezer mechanism and an adjacent freezer cabinet for the storage of frozen foods, said freezer mechanism comprising:

(P) a compressor for compressing low pressure vapor refrigerant into high pressure hot gas refrigerant;

(Q) a condenser for condensing high pressure hot gas refrigerant from said compressor into high pressure liquid refrigerant;

(R) thermal expansion means for expanding high pressure liquid refrigerant from said compressor into low pressure liquid refrigerant;

(S) an evaporator having an inlet for receiving and evaporating the low pressure liquid refrigerant from said thermal expansion means to cool said evaporator whereby the outside surface of said evaporator accumulates ice;

(T) blower means adjacent said evaporator for blowing freezing air drawn over said evaporator into said adjacent freezer cabinet;

(U) an evaporator condensate container mounted beneath said evaporator;

(V) a compressor condensate container mounted beneath said compressor and connected by a condensate conduit to said evaporator condensate container;

(W) an evaporator condensate container heater coil attached to and in thermal contact with the bottom of said evaporator condensate container, said evaporator condensate container heater coil having an inlet and an outlet;

(X) a hot gas tube connecting the outlet of said evaporator condensate container heater coil directly to the low pressure side of said thermal expansion means and thereby directly to the inlet of said evaporator;

(Y) a hot gas valve for conducting when activated high pressure hot gas refrigerant from said compressor directly to the inlet of said evaporator condensate container heater coil to heat said condensate container heater coil and thereby heat said attached evaporator condensate container;

(Z) the heat from said heated evaporator condensate container then heating the outside of said evaporator to help melt ice accumulated on the outside of said evaporator into condensate water which drips into said evaporator condensate container;

(AA) high pressure hot gas refrigerant fed via said hot gas tube from the outlet of said evaporator condensate container heater coil directly to the inlet of said evaporator heating the inside of said evaporator and further melting ice accumulated on the outside of said evaporator into condensate water which drips into said evaporator condensate container;

(BB) said condensate water flowing from said evaporator condensate container via said condensate conduit to said compressor condensate container;

(CC) and condensate evaporating means separate from said evaporator condensate container for evaporating the condensate water in said compressor condensate container; said condensate evaporating means comprising:

(DD) a condenser fan mounted horizontally adjacent said condenser and vertically over said compressor and adapted to move air through said condenser and around said compressor to cool said condenser and compressor;

(EE) a compressor section separate from said evaporator including said compressor;

(FF) enclosure means for enclosing said compressor section on all sides except for one side;

(GG) a panel on said one side of said compressor section having a top opening adjacent its top and a bottom opening adjacent its bottom;

(HH) said condenser fan moving air drawn through said top opening of said panel, through said condenser to warm the moved air, around said compressor to further warm the moved air, then over the condensate water in said compressor condensate container to evaporate the condensate water solely by said warmed moved air, and then expel the evaporated condensate water in the moved air out said bottom opening of said panel.

21. A freezer system comprising:

(A) an evaporator section;

(B) a compressor section adjacent said evaporator section;

(C) an insulating wall separating said evaporator section and said compressor section;

(D) an evaporator coil mounted in said evaporator section;

(E) a first condensate container mounted beneath said evaporator coil to contain water condensed on the outside of said evaporator coil;

(F) a compressor mounted in said compressor section;

(G) a condenser coil mounted adjacent and substantially over said compressor;

(H) a condenser fan mounted horizontally adjacent said condenser coil and vertically over said compressor and adapted to force air through said condenser coil and around said compressor to cool said condenser coil and said compressor;

(I) a second condensate container mounted in said compressor section below at least part of said compressor, the bottom of said second condensate container being below the bottom of said first condensate container;

(J) condensate conduit means for conducting condensate in said first condensate container through said insulating wall into said second condensate container;

(K) enclosure means for enclosing said compressor section on all sides except for one side;

(L) a panel on said one side of said compressor section having a top opening adjacent its top and a bottom opening adjacent its bottom;

(M) said condenser fan forcing air drawn through said top opening of said panel, through said condenser coil to warm the forced air, around said compressor to further warm the forced air, then over said condensate in said second condensate container to evaporate said condensate solely by said warmed forced air, and then expel said evaporated condensate in the forced air out said bottom opening of said panel.

22. The freezer system of claim 21 wherein the temperature of the hot air passed over the condensate water in said compressor condensate container is in the range of 140° F.–160° F.

23. The freezer system of claim 21 wherein the temperature of the hot air passed over the condensate water in said compressor condensate container is in the range of 140° F.–160° F. and the movement of the hot air is in the range of 350 to 450 cubic feet per minute.

* * * * *